US011859930B2

(12) United States Patent
Markut et al.

(10) Patent No.: US 11,859,930 B2
(45) Date of Patent: Jan. 2, 2024

(54) TRIGGER UNIT FOR A FIREARM

(71) Applicant: GLOCK TECHNOLOGY GMBH, Ferlach (AT)

(72) Inventors: Karl Markut, Klagenfurt (AT); Andreas Werdnig, Klagenfurt (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 90 days.

(21) Appl. No.: 17/757,138

(22) PCT Filed: Nov. 27, 2020

(86) PCT No.: PCT/EP2020/083689
§ 371 (c)(1),
(2) Date: Jun. 9, 2022

(87) PCT Pub. No.: WO2021/121908
PCT Pub. Date: Jun. 24, 2021

(65) Prior Publication Data

US 2023/0003476 A1 Jan. 5, 2023

(30) Foreign Application Priority Data

Dec. 17, 2019 (EP) ..... 19216895

(51) Int. Cl.
*F41A 19/16* (2006.01)
*F41A 19/15* (2006.01)
(Continued)

(52) U.S. Cl.
CPC ..... *F41A 19/16* (2013.01); *F41A 11/02* (2013.01); *F41A 19/02* (2013.01); *F41A 19/15* (2013.01); *F41A 19/45* (2013.01)

(58) Field of Classification Search
CPC ..... F41A 19/16; F41A 19/02; F41A 19/15; F41A 19/45; F41A 11/02
(Continued)

(56) References Cited

U.S. PATENT DOCUMENTS 4,450,751 A * 5/1984 Thevis ..... F41A 19/02 89/129.02
7,421,937 B1 * 9/2008 Gangl ..... F41A 19/16 89/142
(Continued)

FOREIGN PATENT DOCUMENTS

CA 2659438 A1 * 2/2008 ..... F41A 17/46
DE 202011004556 U1 7/2012
EP 2950033 B1 11/2016

OTHER PUBLICATIONS

International Search Report for PCT/EP2020/083689, dated Apr. 19, 2021

*Primary Examiner* — Samir Abdosh
(74) *Attorney, Agent, or Firm* — Raven Patents, LLC; Anton E. Skaugset

(57) ABSTRACT

A trigger unit for a firearm, including a hammer rotatable about a hammer axis and prestressable by a hammer spring, a trigger lever rotatable about a trigger axis, the trigger lever has a trigger and a trigger rear, which receives at least one interrupter. A sear is rotatably mounted about a sear axis and prestressable by a sear spring. The sear axis and the trigger axis coincide, and the sear has a bearing recess for receiving and limited rotation about a disconnector axis of a disconnector pivot formed on the underside of the disconnector, the bearing recess being formed surrounding the disconnector pivot at least partially in the direction of rotation about the disconnector axis.

19 Claims, 8 Drawing Sheets

(51) Int. Cl.

| | |
|---|---|
| ***F41A 11/02*** | (2006.01) |
| ***F41A 19/02*** | (2006.01) |
| *F41A 19/45* | (2006.01) |

(58) Field of Classification Search
USPC ..... 42/69.01
See application file for complete search history.

(56) References Cited

U.S. PATENT DOCUMENTS

| | | | | |
|---|---|---|---|---|
| 7,600,338 | B2 * | 10/2009 | Geissele | F41A 19/10 89/139 |
| 10,330,413 | B2 * | 6/2019 | Williams | F41A 17/74 |
| 11,454,471 | B1 * | 9/2022 | Pittman | F41A 19/45 |
| 2009/0188145 | A1 | 7/2009 | Fluhr et al. | |
| 2016/0131449 | A1 * | 5/2016 | Horch | F41A 19/12 42/69.01 |
| 2016/0161202 | A1 * | 6/2016 | Larue | F41A 19/45 42/69.01 |
| 2016/0178304 | A1 * | 6/2016 | Geissele | F41A 19/16 42/69.01 |
| 2016/0363401 | A1 * | 12/2016 | Elftmann | F41A 19/14 |
| 2017/0299306 | A1 * | 10/2017 | Larson, Jr. | F41A 17/46 |
| 2019/0257606 | A1 * | 8/2019 | Olson | F41A 17/56 |
| 2022/0018620 | A1 * | 1/2022 | Elftmann, Jr. | F41A 19/14 |
| 2023/0221087 | A1 * | 7/2023 | Strbac | A61L 24/0036 42/69.01 |

* cited by examiner

Fig. 5A A-A´
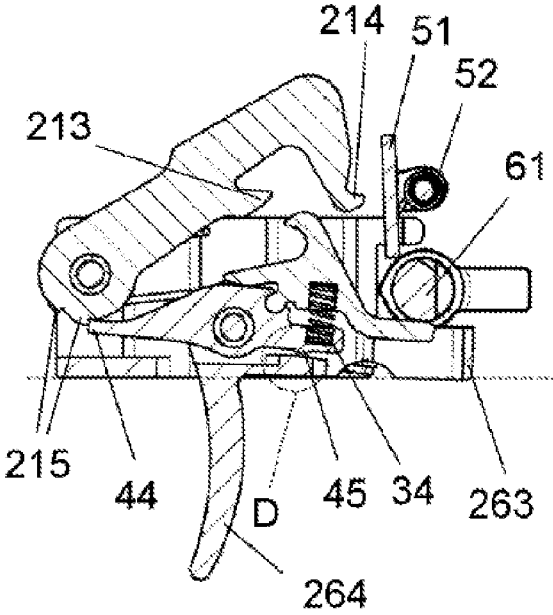
Fig. 5B B-B´
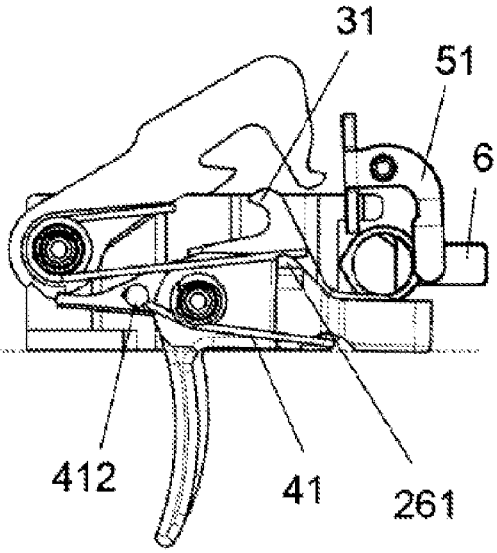
Fig. 5C
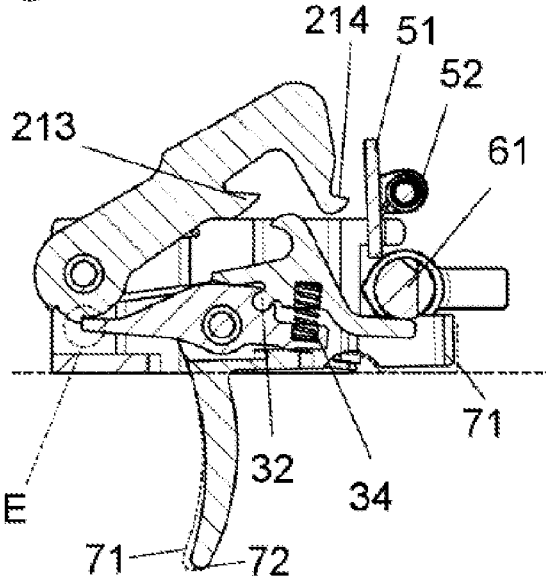
Fig. 5D
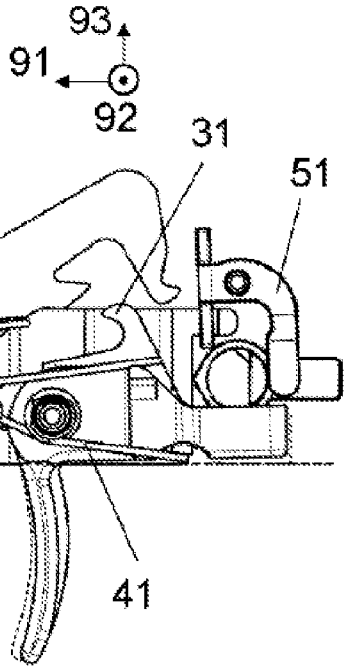

Fig. 6A A-A´
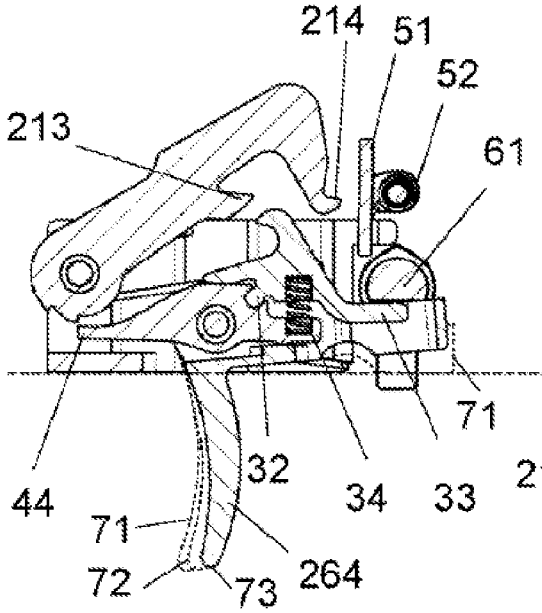
Fig. 6B B-B´
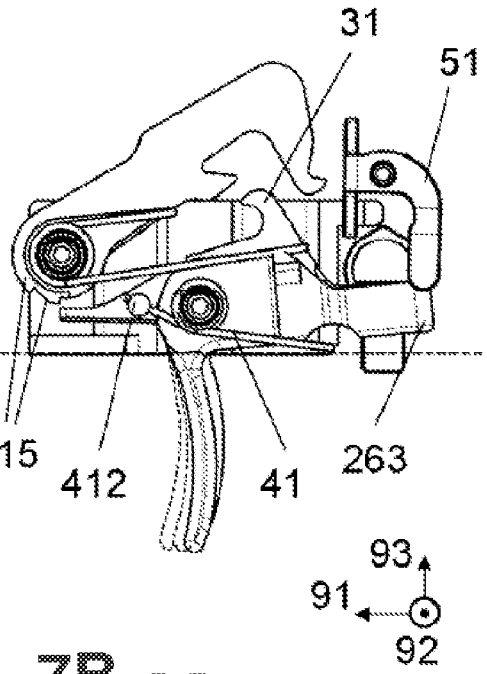
Fig. 7A A-A´
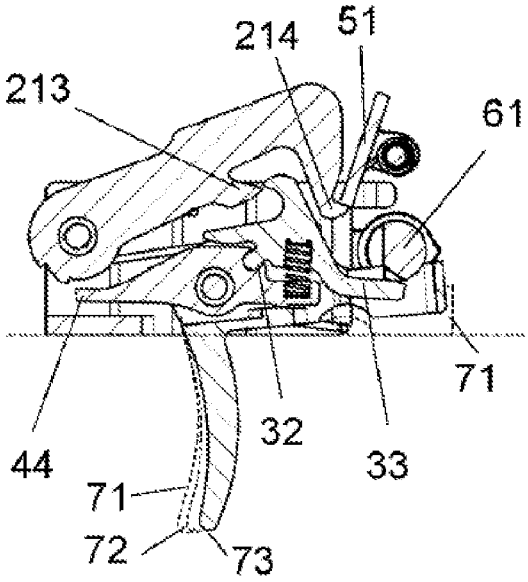
Fig. 7B B-B´
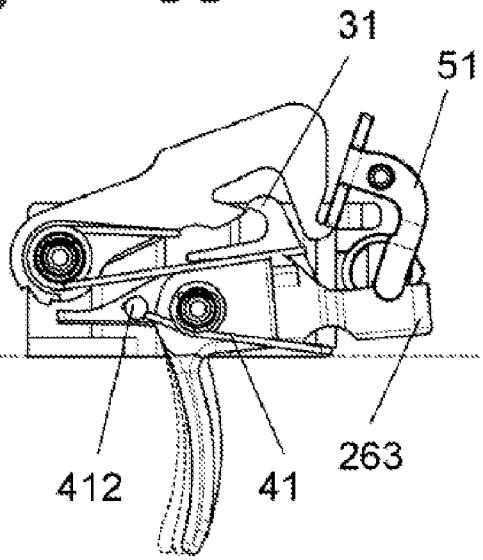

TRIGGER UNIT FOR A FIREARM

TECHNICAL FIELD

The present disclosure relates to firearms, and more particularly to a two-stage trigger unit, also called a trigger device, which is suitable for both handguns and rifles.

BACKGROUND

The US 2016/0363401 A1 discloses a modular trigger and hammer assembly, having a hammer, a trigger, a disconnector and a hammer spring. Hammer and trigger are rotatably mounted in a housing, which is fixedly secured within the weapon; the disconnector is rotatably mounted on the elongated rear side of the trigger. A sear is rotatably mounted on the trigger in an area between and above the trigger axis and the hammer axis. Various springs are provided to bring the complex in working position, all mentioned parts are positioned side by side.

Since such trigger units can be used interchangeably as modules in existing weapons and the weapons themselves only provide the geometric and functional boundary conditions, the present disclosure primarily relates to such a trigger unit and only secondarily to a weapon with such a trigger unit.

As a rule, a modern trigger unit should be easy to operate, reliable, easy to maintain and adjustable between a "safe" and at least an "operational" state. A large number of such trigger units, especially for AR15 rifles, which are primarily addressed here, have a design which prevents the selector from being moved into the "safe" position when the hammer is in the striking position. This is often due to the fact that the trigger lever, comprising a selector (also often referred to as a safety lever), the trigger and the trigger catch (usually referred to as a "sear") interacting with the hammer (also referred to as a striking piece) is designed in one piece. Examples are U.S. Pat. No. 10,330,413 B2, EP 2 950 033 B1, U.S. Pat. No. 7,600,338 B2, from which these correlations are very clearly evident.

It is also a concern to provide the shooter with a trigger unit that requires a two-stage resistance structure to discharge the firearm. These trigger resistances should be perceptible and distinguishable by the shooter when the trigger is actuated. Here, too, a large number of two-stage trigger units are known, which have a first trigger resistance (e.g. "pre-pull resistance") and a second trigger resistance (e.g. "main trigger resistance"). Overcoming the first and second trigger resistance is often referred to as "first stage" and "second stage" in English. U.S. Pat. No. 7,600,338 B2 and US 2019/257606 A1 should be mentioned as representative for the many different design possibilities, since very different components are responsible for the mode of action.

The content of DE 20 2011 004 556 U1, EP 2 950 033 B1, U.S. Pat. Nos. 7,600,338 B2, 10,330,413 B2, US 2016/0363401 A1 and US 2019/257606 A1 is incorporated by reference into this application and description for the jurisdictions where this is possible.

What is needed is therefore a trigger unit which enables the firearm to be secured when the hammer is struck. A further object of the present disclosure is to provide a two-stage trigger unit with different trigger resistances. Another object of the present disclosure is to provide a trigger unit that is easy to handle, easy to maintain and relatively easy to replace as a "drop-in trigger unit."

SUMMARY

The present disclosure provides two-stage trigger units suitable for use in firearms, and in particular suitable for firearms of the rifle type M4/M16/AR15. The trigger units of the disclosure are not limited to rifles, carbines, etc., but can in principle also be used for pistols.

In one example, the trigger units of the present disclosure include a hammer that is rotatably mounted about a hammer axis and prestressable by means of a hammer spring; a trigger lever rotatably mounted about a trigger axis, the trigger lever having a trigger and a trigger rear, where the trigger lever is formed to receive at least one disconnector; and a sear mounted rotatably about a sear axis and prestressable by means of a sear spring; provided that the sear is arranged at least partially within the trigger lever such that the sear axis and the trigger axis coincide; and the sear has on an upper side a bearing recess for receiving a disconnector pivot formed on an underside of the disconnector, the bearing recess providing limited rotation of the disconnector about a disconnector axis, and the bearing recess at least partially enclosing the disconnector pivot in the direction of rotation about the disconnector axis.

BRIEF DESCRIPTION OF THE DRAWINGS

FIGS. 5A-5D: a schematic sectional view along plane A-A' or B-B' of FIG. 2B before the shot is fired or in the selector position "Safe" in various positions on the empty pull;

FIGS. 6A and 6B: a schematic sectional view along level A-A' or B-B' of FIG. 2B for the selector position "single fire" in the release position;

FIGS. 7A and 7B: a schematic sectional view along plane A-A' or B-B' of FIG. 2B for the selector position "continuous fire" in the catch position of the hammer;

DETAILED DESCRIPTION

Figure 1:
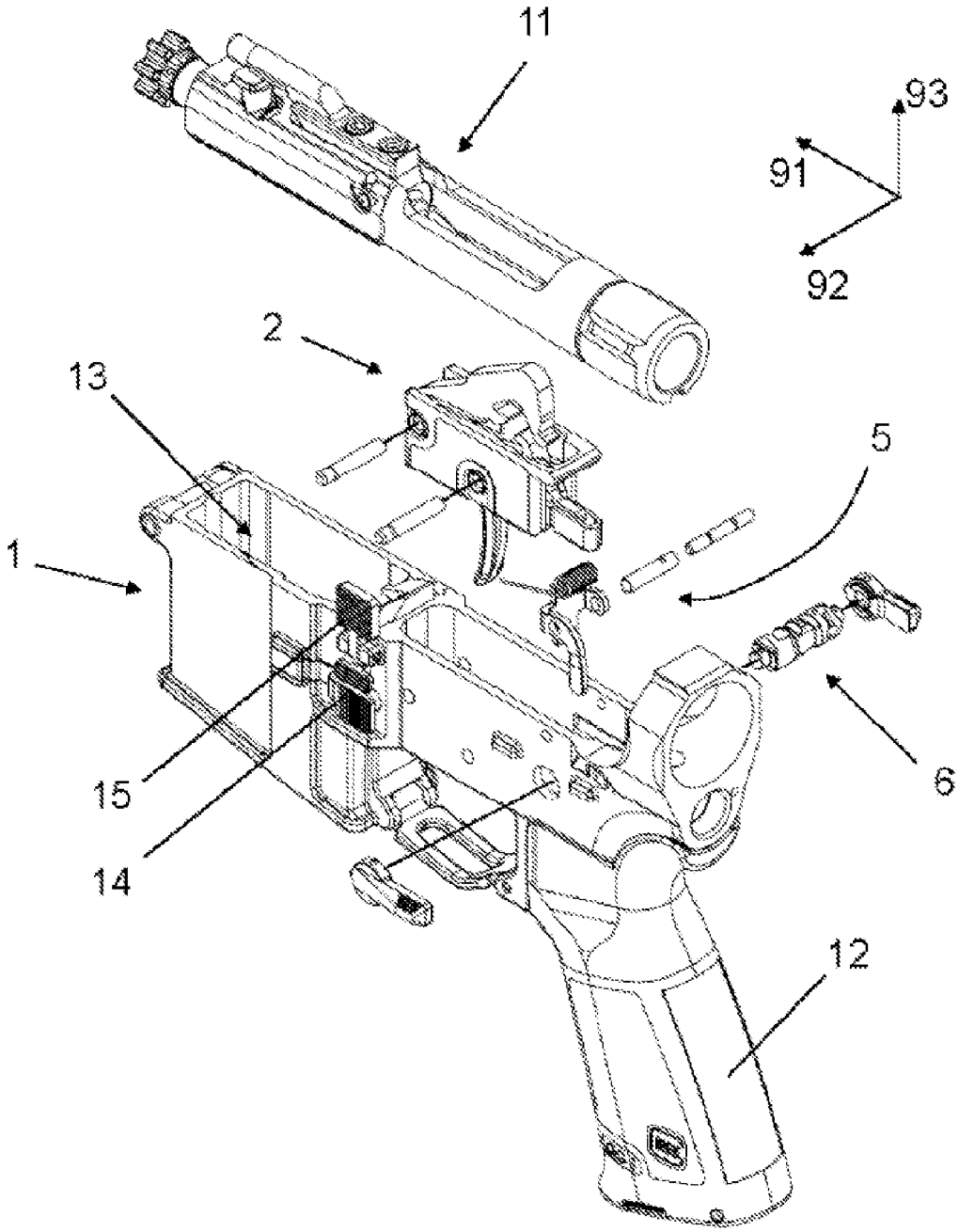
FIG. 1: purely schematically, in a perspective exploded view, a lower housing with magazine holder and handle, as well as an illustrative trigger unit, continuous fire group, selector and bolt carrier.

The problems exhibited by previously described trigger units can be solved by the use of a trigger unit having the features recited in the present disclosure. In other words, the sear with its sear axis and the trigger lever with its trigger axis form a common axis of rotation, wherein the sear has on its upper side a bearing recess for receiving and limited rotation about a disconnector axis of a disconnector pivot joint formed on the underside of the disconnector and wherein the bearing recess is formed surrounding the disconnector pivot at least partially in the direction of rotation about the disconnector axis.

In still other words, the parts are not positioned side by side as in US 2016/0363401 A1, but are nested one inside the other. Further, the disconnector is rotatably mounted on the sear, and not on the trigger. Finally, the sear axis and the trigger axis are one and the same, which is possible due to the nesting.

In this way, the hammer, which is mounted rotatably about a hammer axis and can be prestressed by means of a hammer spring, is no longer blocked by the trigger in the struck state. The trigger lever, which is mounted rotatably about the trigger axis, integrally comprises a trigger and a trigger rear, which is designed to accommodate at least one disconnector. The design and arrangement according to the present disclosure, or the interaction of sear, disconnector and trigger lever allow an adjustment of the selector in the struck state up to the "safe position", since the trigger rear is easily deflectable in this state.

The bearing recess and the disconnector pivot are substantially complementary in shape to each other to allow rotation about the disconnector axis within limits. The assembly can be done relatively easily by pushing the disconnector together sideways, as explained in further detail with reference to the drawings. When installed, this also reduces the likelihood that any of the components of the trigger unit are lost.

Throughout the description and the claims "front" or "(to the) front" are used as a direction towards the muzzle of the barrel, "(to the) rear" as a direction towards the well, "(downwards) down" as a direction for the latch towards the magazine, and "(upward) up" as a direction away from the magazine. The terms "weapon center plane," "barrel core," "barrel axis," "core axis," etc. have the usual meaning that the person skilled in the art attaches to them in the prior art. "Left" thus refers to the weapon center plane, "from left" corresponds to a movement, actuation, exertion of force in the direction of the center plane of the weapon, starting from a starting position to the "left" of it, etc. After a shot has been fired, the latch is moved "to the rear" under the effect of the gases and then "to the front" again under the effect of a closing spring, etc.

In the context of the present disclosure, a trigger unit which is suitable for placement in a firearm, preferably a rifle, is referred to as "2" in its entirety. This should explicitly include a "drop-in trigger unit," i.e. an "installation or retrofit module," which summarizes the trigger unit 2 according to the present disclosure in a trigger unit housing 23 in advance and facilitates the installation in a firearm.

In the figures of the drawings, an attempt was made to designate everything that concerns trigger unit 2 as "2*n*," as well as analogously "21*n*" for the hammer, "3*n*" for the disconnector, "4*n*" for the sear, "5*n*" for the continuous firing unit and "6*n*" for the selector.

It is clear to the person skilled in the art that the embodiments depicted were chosen as schematic and/or exemplary representations and that it is easily possible for a person having ordinary skills in the art with the benefit of the present disclosure, to transfer the connections according to the present disclosure also to embodiments not explicitly shown, which is why these implicitly disclosed embodiments can be gleaned both from the description of the figures and from the claims.

FIGS. 1 to 11 primarily show exemplary embodiments of the present disclosure which are suitable for use in an AR15 or M4 rifle. Modifications can also be transferred to other types of rifles by the person skilled in the art with knowledge of the disclosure simply and without extensive or complex tests.

FIG. 1 shows a schematic exploded view of a trigger unit 2, shown as a drop-in trigger unit, prior to insertion into a lower housing 1 of a rifle. In the normal direction 93 (vertical) above the trigger unit 2, a bolt carrier 11 is shown, which in the rest position of the weapon, i.e. before firing, is mounted above the trigger unit 2 in an upper housing (not shown). In addition, a grip 12, a magazine catch 14 and a bolt catch lever 15 can be seen on the lower housing 1 when installed. FIG. 1 also shows an auto sear unit 5 and a selector 6 in exploded view, which are not to be seen as part of the trigger unit 2 according to the present disclosure, but are to be described for their function.

Figure 2A:
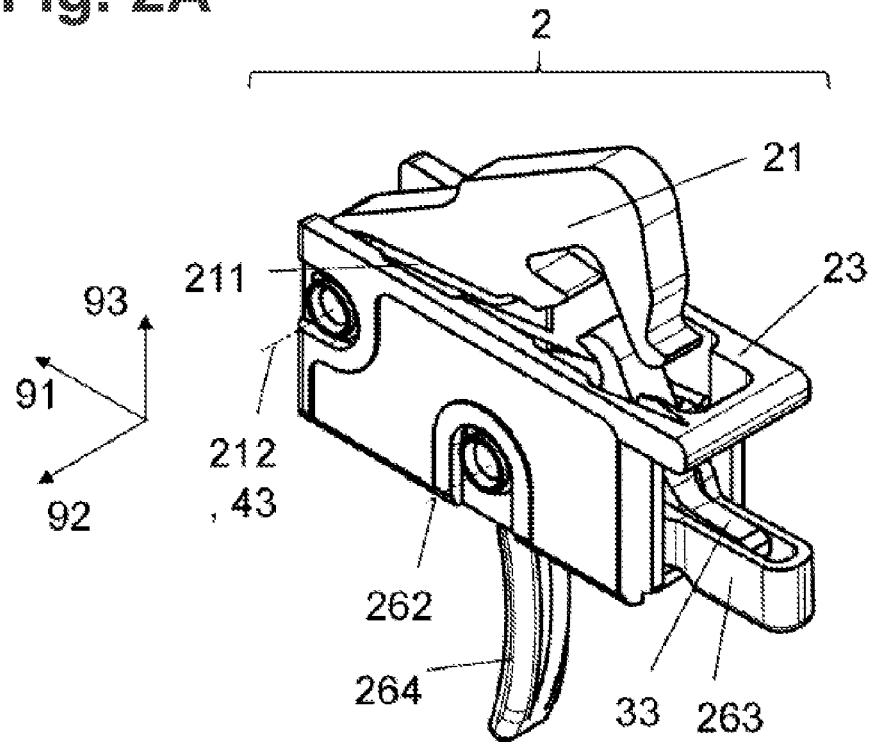
FIGS. 2A and 2B: a schematically shown illustrative trigger unit assembled in a trigger housing in a perspective representation and a top view.
Figure 2B:
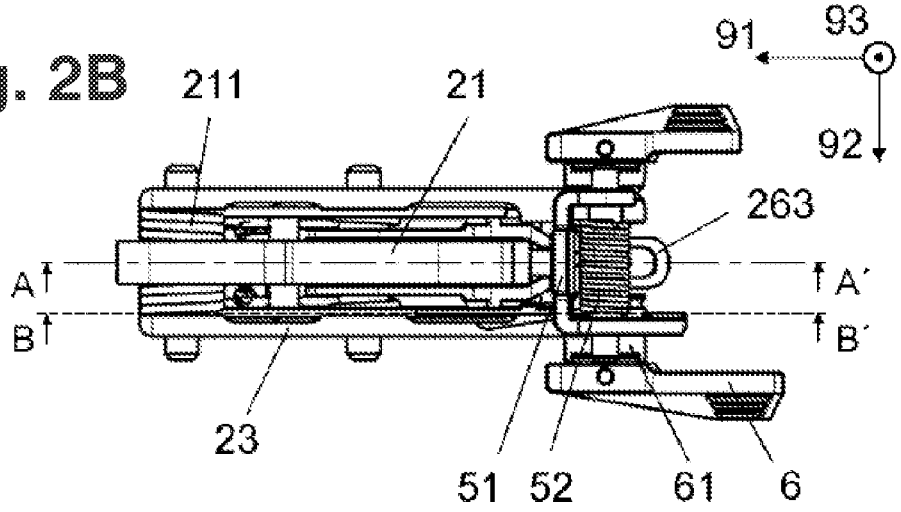

In addition, as can be seen from FIGS. 1 and 2B, the auto sear unit 5 usually comprises an auto sear 51 and a continuous fire spring 52, as well as a sleeve and a pin for fixing in the housing 1. Likewise, the selector 6 in the form shown comprises two actuating members and a control shaft 61, whereby the control shaft 61 is arranged inside the housing 1 and can be adjusted by the two actuating members from the outside in its angular position, i.e. by rotation about the transverse direction 92. The control shaft 61 has a geometry which, by forming differently shaped cams along the control shaft 61, interacts with different parts of the trigger unit 2 depending on the position of the selector 6. The control shaft 61 is substantially designed as can be seen, for example, from DE 20 2011 004 556 U1 or EP 2 950 033 B1.

In FIG. 2A, a composite drop-in trigger unit can be seen in a perspective view, which is shown in the rest position. At this point it should again be noted that the trigger unit 2 according to the present disclosure can theoretically also be installed without a trigger unit housing 23, i.e. directly in the lower housing 1, provided that smaller adaptations, such as a support for the sear spring 41 are provided in housing 1. The illustrations show the preferred embodiment as a drop-in trigger unit.

Figure 3:
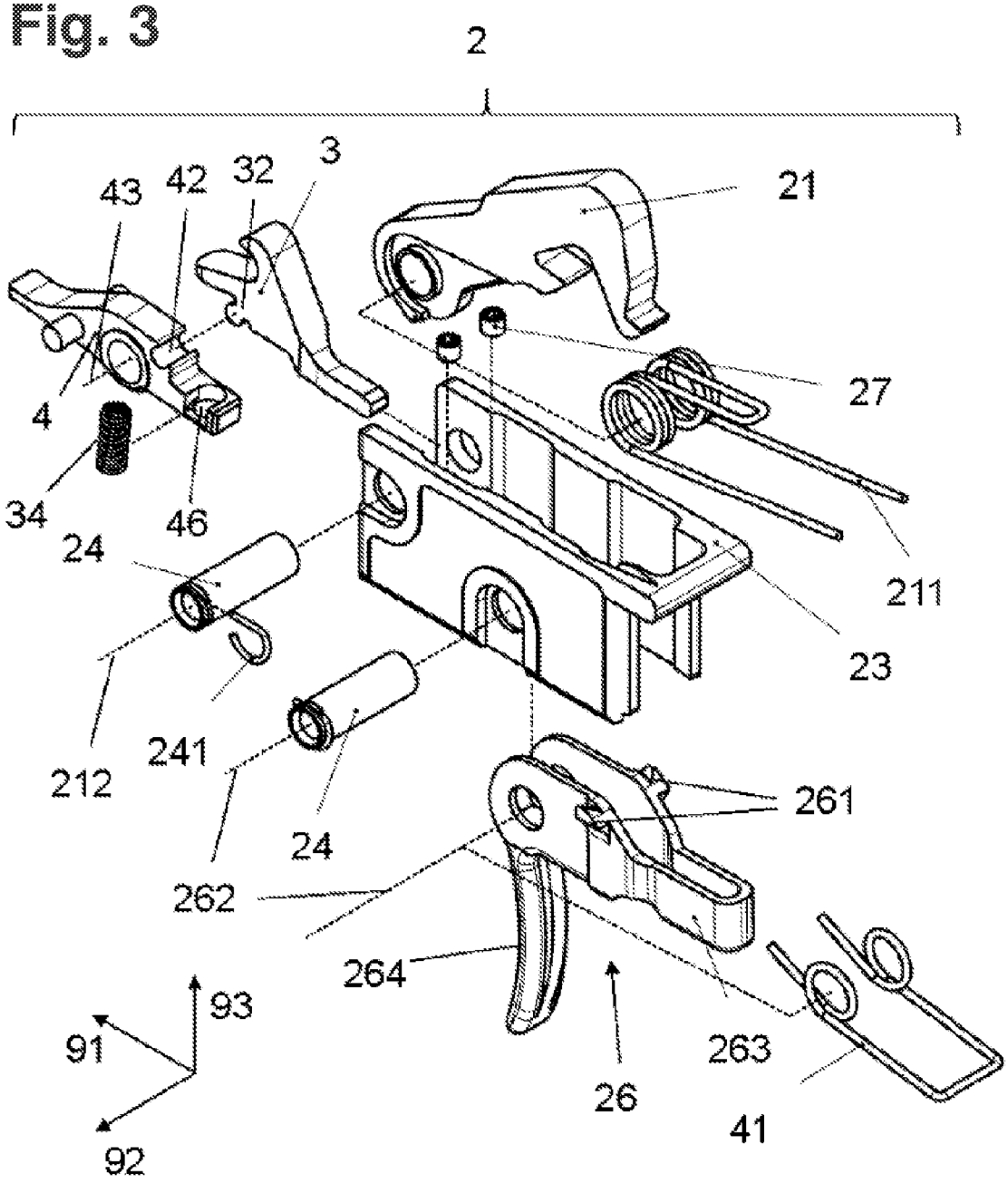
FIG. 3: a schematic exploded view of an illustrative drop-in trigger unit.

In FIG. 2B, the rest position of the trigger unit 2 can be seen in a plan view and explained in conjunction with FIG. 3: A hammer 21, also often referred to as striking pin, is mounted in the trigger unit housing 23, or more precisely in a bearing sleeve 24, so that it can rotate about a hammer or hammer axis 212. The disconnector 3, which is located inside the trigger 26, is also very clearly visible. FIG. 2B also shows the superimposed illustration of the trigger unit 2 with the auto sear unit 5 and the selector 6, as it corresponds to the installation situation and becomes clear in conjunction with FIG. 1.

FIG. 3 shows another exemplary representation of the trigger unit 2 in an exploded view, whereby the dashed lines are to be seen as reference lines to illustrate the position of the components in relation to each other in the installation situation. From the illustration, the multi-part nature of the trigger unit 2 according to the present disclosure can be seen very clearly, whereby the trigger lever 26 in particular has no specific shape, i.e. no dedicated front section, in the barrel direction 91 to the front, as can very often be seen in the prior art. The mechanical engagement on the hammer 21 or its hammer cams 215 (e.g. FIG. 5) does not take place directly with the trigger lever 26, but indirectly via a separately designed sear 4. According to the present disclosure, the sear 4 and the trigger lever 26 have a common axis of rotation in the installation situation which, accordingly, is designated both as the trigger axis 262 and as the sear axis 43. In addition, according to the present disclosure, the sear 4 is connected to a disconnector 3 in such a way that the sear 4 has on its upper side a bearing recess 42 for receiving and limited rotation of a disconnector pivot 32 formed on the underside of the disconnector 3. A bearing recess 42 encloses the disconnector pivot 32 at least partially in the direction of rotation about the disconnector axis 35, which runs through the disconnector pivot 32 in the transverse direction 92. In the installation situation, this permits a limited rotation of the disconnector about the disconnector axis 35 and, due to the formation of a common sear axis 43 or trigger axis 262, the sear 4 and the disconnector 3 can be tilted individually and jointly or rotated within limits. The sear 4 and the disconnector 3 are at least partially laterally mounted by the trigger 26.

It can also be seen that in the installation situation a sear spring 41 is held on both sides of the trigger 26 by the bearing sleeve 24 in the trigger unit 2. The curved rear continuous leg of the sear spring 41 engages on the underside of the trigger housing 23 in the exemplary embodiment shown (see also e.g. FIG. 5A). This type of spring support can also be provided by the person skilled in the art in other ways, such as by means of appropriate support points on the inside of the lower housing 1. However, according to the present disclosure, the two loose ends of the sear spring 41 are supported on the sear 4 on the underside of the sear spring supports 412 provided for this purpose. This causes a sear edge 44 of the sear 4 to be prestressed upwards in the direction of the hammer 21.

The hammer 21 is prestressed in the installation situation using the corresponding hammer spring 211. The hammer spring 211 is stretched in the usual way against the hammer 21 with the center connecting piece from below and can be supported by the bearing sleeve 24, which holds the trigger 26. In the embodiment shown, e.g. in conjunction with FIG. 3, projecting hammer spring supports 261 can be provided laterally on the trigger 26, which act as abutments for the hammer spring 21 and thus prevent the hammer spring 21 from resting on the sear spring 41. Due to the support of the hammer spring 21, according to the present disclosure, on the hammer spring supports 261 provided for this purpose, but basically also on the bearing sleeve 24 or the sear spring 41, there is also a force transmission which pushes the trigger lever 26 with its trigger rear 263 downwards in the normal direction 93. This connection is advantageous for the design of the trigger unit 2 according to the present disclosure, since it transmits a force to be overcome to the trigger 26 and thus noticeably to the shooter on the trigger 264, which is perceived as the "first stage" and defines the resistance in the pull, which will be explained later.

The analysis of the following FIGS. 5 to 11 makes it clear to the person skilled in the art that the tasks according to the present disclosure can be solved by means of the one-piece components shown as examples, in particular the trigger 26, the sear 4, the disconnector 3 and the hammer 21. It should be noted at this point that multi-part sears 4 and/or disconnectors 3 are also conceivable, which interact in an analogous way.

Figure 4A:
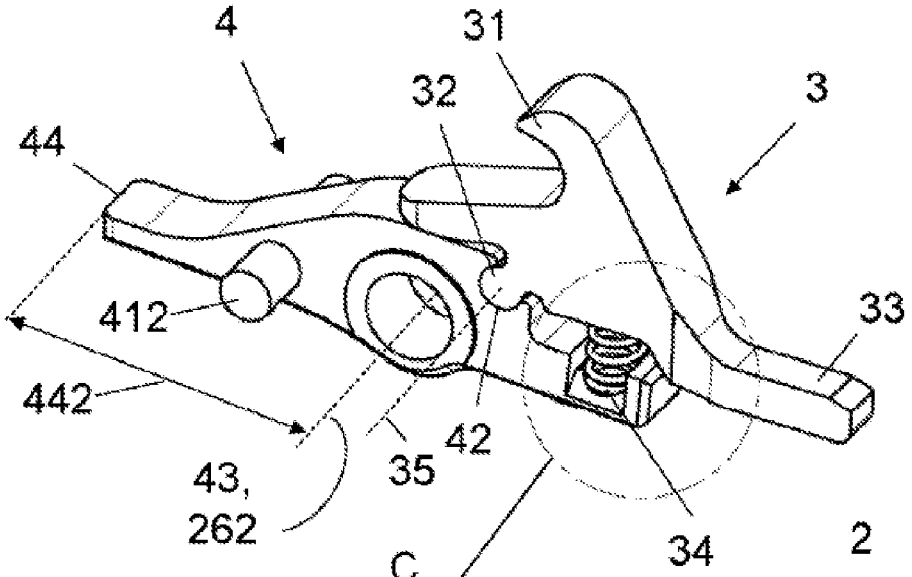
FIGS. 4A and 4B: an enlarged schematic representation of the disconnector and the sear of the trigger unit; in the assembled state and an enlarged cutout "C" in the region of the spring recess of the sear from FIG. 4A.
Figure 4B:
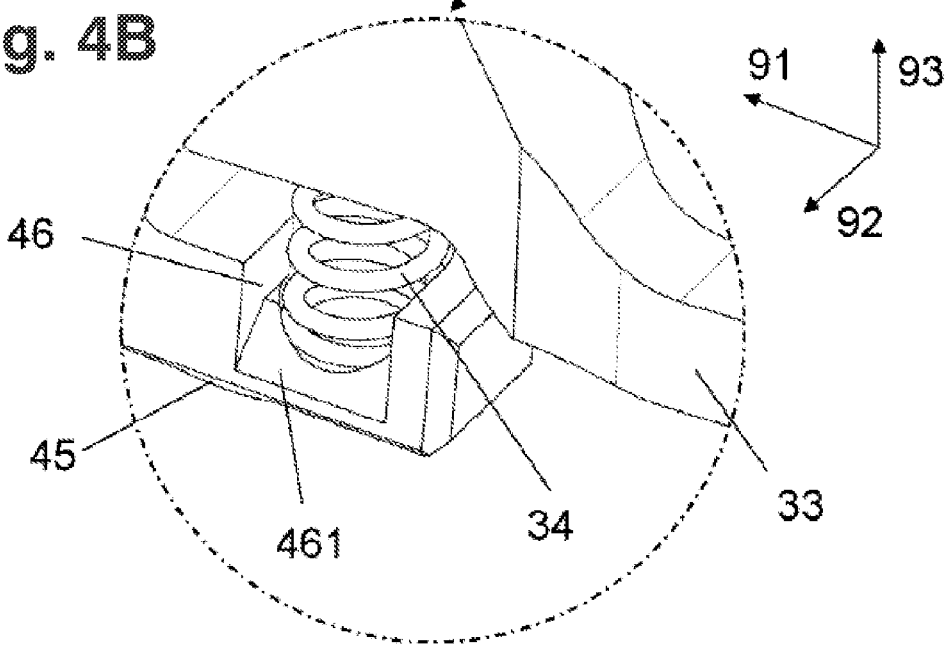

In FIGS. 4*a* and 4*b* the sear lever 4 and the disconnector 3 are shown enlarged. The disconnector 3 has a hook 31 on the upper side which interacts with the hammer hook 213. At its rear end the disconnector 3 has a back end 33, which in transverse direction 92, as shown, can have a smaller extension than the center or front section. This makes accommodation/insertion in the rear of the trigger 263 easier. The disconnector 3 can, as shown, have formed a kind of support lug in the front section for guiding along the upper side of the sear 4. The guide and/or also the support on the upper side of the sear 4 can also be achieved by an alternative, functionally identical design of the pairing bearing recess 42 and disconnector pivot 32. Further, one may see the distance 442, d, between the axis 262 which is the same as the axis 43 and the outermost end of sear 4. The meaning of this distance will be explained in connection with FIGS. 5A-5D and the detail of FIG. 10.

The disconnector 3 has a disconnector pivot 32 on its underside, which serves to accommodate and rotatably mount on the upper side of the sear 4 and which defines a disconnector axis 35 in the transverse direction 92. In addition, a receptacle for a disconnector spring 34 is provided on the underside of the disconnector 3. The diameter and depth of this receptacle, which is better visible in cross-section e.g. in FIG. 5A, is adapted to the disconnector spring 34 in such a way as to decrease the risk of it slipping out sideways.

In a special embodiment, the sear 4, as enlarged in detail C in FIG. 4B, also has a spring recess 46. This spring recess 46 is formed on the upper side, i.e. facing the disconnector 3, and serves, like the mounting in the disconnector 3, to at least partially mount and loss protect the disconnector spring 34.

In the advantageous further embodiment shown, the spring recess 46 is partially open in at least one transverse direction 92, which facilitates assembly, as the disconnector spring 34 does not have to be compressed to the point where it can be inserted into the recess or receptacle.

A further aid for the assembly is provided by a ramp 461 provided at the side in the area of the opening to the spring recess 46. Because the ramp 461 rises in the direction of the spring recess 46, the disconnector spring 34 can be inserted more easily from the side, i.e. moved over it.

In all the cases described, however, the function of the disconnector spring 34 is the same in that it prestresses the disconnector 3 around the disconnector axis 35, i.e. substantially upwards in the direction of the hammer hook 213. The bearing recess 42 is substantially complementary in shape and function to the disconnector pivot 32, whereby a partial rotation of the disconnector 3, i.e. within defined limits, is made possible in addition to the mounting. The assembly of the sear 4 and the disconnector 3 is therefore carried out by shifting from one side in the transverse direction 92, whereby an independent disassembly or disintegration during operation is avoided by the lateral limitation within the trigger unit housing 23 or also lower housing 1 of the firearm.

FIGS. 5 to 8 describe the function of the trigger unit 2 in more detail. The sectional views of the different rest and working positions of FIGS. 5A, 5C, 6A, 7A, 8A, and 8B correspond to a side view through the center plane along the section line A-A', as shown as an example for the rest position in FIG. 2B. The sectional views of the different resting and working positions of FIGS. 5B, 5D, 6B, and 7B correspond to a side view through the plane along the section line B-B', as shown as an example for the rest position in FIG. 2B, which substantially corresponds to a side view without the "left side wall" of the trigger unit housing 23. The rest position 71, the first trigger stage 72 (1st stage) and the second trigger stage 73 (2nd stage) are illustrated by dotted lines in the area of the trigger 264 and/or the trigger rear 263.

FIGS. 5A and 5B show the rest position 71 of the trigger unit. The hammer 21 is tensioned, i.e. the hammer spring 211 attempts to rotate the hammer head counter-clockwise around the hammer axis 212 (FIG. 2) and rests on the hammer spring supports 261. The hammer 21 has at least one hammer cam 215 on its outer surface in the area of the hammer axis 212, which is held in the rest position by a sear edge 44 of the sear 4. The sear edge 44 is prestressed by the sear spring 41 against the hammer 21 by engaging in the sear spring supports 412. As shown, the trigger lever 26 is preferably integrally designed and has a trigger 264 which projects substantially downward in the normal direction 93. In addition, the trigger lever 26 has an opening in its center section and in the rear direction in the rear 263 to accommodate the sear 4 and the disconnector 3.

In FIGS. 5A and 5B it can be seen very clearly that the trigger 264 of the rest position 71 is prestressed by the hammer spring 211, because the trigger lever 26 is pushed down. It can also be seen very clearly that the selector 6 is in the "safe" position, whereby the control shaft 61 in one section blocks the disconnector 3 on the back end 33 on the upper side and prevents a deflection upwards.

A comparative examination of FIGS. 5C and 5D shows that a slight deflection to the rear is possible when a first force is applied to the trigger 264, whereby the trigger rear 263 is rotated upwards until the trigger lever 26 comes into contact on its inner surface 25 with the underside of the sear 4 in the contact area of detail D. This slight idle travel is also referred to as pull and can be clearly perceived by the shooter through the retention force of the hammer spring 211 on the trigger 26. This first trigger resistance is thus perceived between the rest position 71 and the end of the pull. The end of the pull is thus referred to as the first trigger stage 72, which is also often referred to as the "first stage" in the Anglo-American linguistic area. The first trigger stage 72 of this two-stage trigger unit 2 can be perceived, as shown in FIGS. 5C and 5D, for example. The design according to the present disclosure allows the same perception of the first trigger stage 72 even in the unsecured condition of the firearm, e.g. when the selector 6 is moved to the position "single fire" or "continuous fire," as a comparison with FIGS. 6 and 7 shows.

In FIGS. 5C and 5D, the rest position 71 of the trigger 264 and the trigger rear 263 is clearly marked in dotted lines. A further deflection of the trigger 264 to the rear via the first trigger stage 72 is prevented in the "securing" position by the rear trigger part 263 resting on both sides with its upper side against correspondingly designed sections of the control shaft 61.

Figure 9:
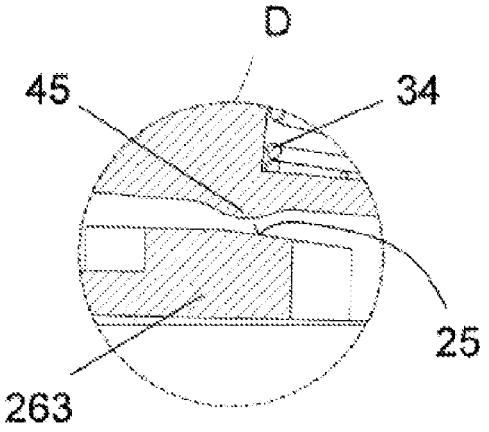
FIG. 9: the detail "D" from FIG. 5A.

Detail D from FIG. 5A is shown enlarged in FIG. 9. This shows particularly advantageous embodiments, which e.g. consist of a sear protrusion 45 formed on the underside of the sear 4. This allows a defined contact position between the inner surface 25 of the trigger level 26 and the underside of the sear 4, whereby the friction can be minimized and the reaching of the first trigger stage 72 can be perceived better. A further embodiment is the incline of the inner surface 25 sloping backwards, as shown in FIG. 9. This inclined surface can also have an advantageous influence on the force transmission between the trigger rear 263 and the sear protrusion 45 by being substantially at right angles—provided that the incline is formed at the corresponding angle. This allows a very precise triggering of the trigger unit and the reaching of the first trigger stage 72.

From the context and the description, it is easy to understand the fact that it is possible to provide different sears 4, which have sear protrusions 45 which protrude to different extents. As shown in FIG. 9, these sear protrusions 45 can be integrally formed on sear 4. In this way a fine adjustment of the pull can be carried out by selecting the desired remaining distance between the inner surface 25 and the sear protrusion 45 of the respective sear 4. Similarly, an adjustable adjustment device 451, preferably designed as an adjustment screw (e.g. grub screw, worm screw) or also as a prismatic adjustment member 451, can function to adjust the part of the sear protrusion 45 that protrudes from the underside.

Figure 11A:
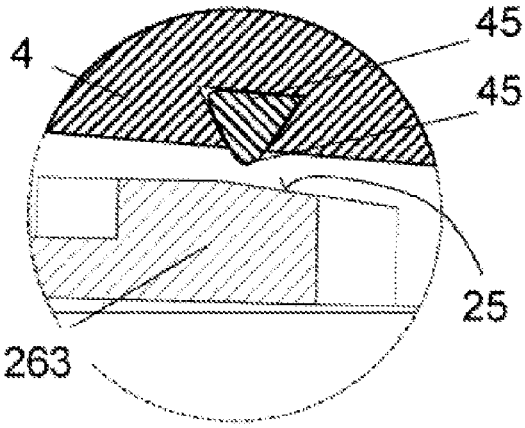
FIGS. 11A and 11B: two prismatic adjustment members in detail.
Figure 11B:
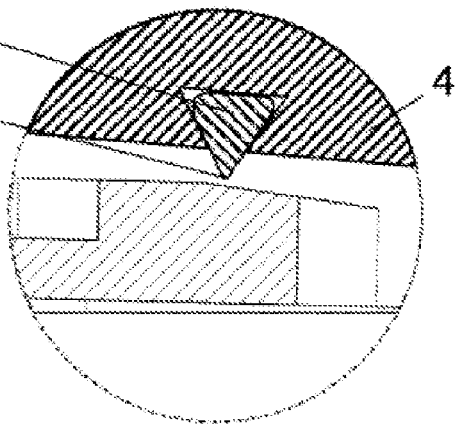

FIGS. 11A and 11B show two prismatic adjustment members 451 as examples, which can be inserted laterally into a recess of the sear 4 corresponding to the rough outer contour of the prism. Due to the differently rounded edges of the prismatic adjustment member 451, a sear protrusion 45 projecting from the sear 4 on the underside to different extents can be formed by pushing it into the desired position, as a comparison of FIGS. 11A and 11B clearly shows. The adjustment members 451 are sufficiently wide in the transverse direction 92 to ensure a stable bearing in the corresponding recess of the sear 4. The prismatic adjustment members 451 are listed as examples of three-sided prisms, whereby four-, five- or even multi-sided prisms are basically also conceivable.

A complementary, or also alternative, possibility for fine adjustment would be to provide different trigger levers 26 with correspondingly adapted inner surfaces 25.

FIG. 6 shows the situation where the selector 6 is put in the "single fire" position and the control shaft 61 with the corresponding sections allows a slight further rotation of the trigger rear 263 about the trigger axis 262. Due to the function of the trigger unit 2, which has already been sufficiently described in FIG. 5 until the first trigger stage 72 is reached, a second, usually higher trigger resistance is perceived when the trigger 264 is deflected further back. This second trigger resistance results in part from the direct force transmission of the trigger lever 26 on the sear 4, since after contacting the sear 4 with the inner surface 25 it must be rotated together about the trigger axis 262. The hammer spring 211 still attempts to push the trigger 26 downwards. On the other hand, the sear edge 44 of the sear 4 must be disengaged from the trigger cam 215 of the hammer 21. In FIGS. 6A and 6B, the rest position 71 and the first trigger stage 72 are therefore schematically indicated as dotted lines on the trigger 264 before the second trigger stage 73 is reached by releasing the sear edge 44 from the trigger cam 215. As shown in FIG. 5, the auto sear unit 5 is still in its rest position.

A further deflection of the trigger 264 to the rear, i.e. a further upward movement of the trigger rear 263, is limited by the control shaft 61. When the hammer 21 is released, it rotates around the hammer axis 212 (see e.g. FIG. 8A) and accelerates to the firing pin within the central recess of the bolt carrier 11. The disconnector 3 attempts to rotate upwards around the disconnector axis 35 by prestressing the disconnector spring 34, which is made possible at least within certain limits by the position of the selector 6, until the back end 33 contacts the corresponding section of the control shaft 61 at the top. Of course, this only applies in the case of the pulled trigger 264—a release of the trigger would require a renewed overcoming of the first trigger resistance, etc.

Since the lock opens after the shot is fired and the bolt carrier 11 moves backwards, the hammer 21 rotates backwards again and is caught in this position with its hammer hook 213 by the hook 31 of the disconnector 3. The bolt carrier 11 is moved forward again by a closing spring, whereby a new cartridge is fed from the magazine into the cartridge chamber of the barrel and the locking head is locked with the barrel.

The hammer 21 is thus caught by the disconnector 3 after each shot in "single fire." Before firing another shot, the prestressing of the disconnector 3 must first release the trigger 264 forward until the sear edge 44 is again positioned in front of the trigger cam 215. If the trigger 264 continues to move forward, the hook 31 is disengaged with the hammer hook 213. Thus again, at least the second trigger resistance must be overcome to reach the second trigger stage 73.

Another situation is described by FIG. 7, in which the position "continuous fire" of the selector 6 is set. Due to the (in most cases) slide-like design of the section of the control shaft 61 corresponding to the back end 33, in this position the disconnector 3 is pressed down after the release of the hammer 21. With the previously described shot firing in "single firing mode" the disconnector 3 can engage with the hammer 21, while with "continuous firing" an engagement of the hook 31 in the hammer hook 213 is suppressed. In order to prevent the hammer 21 from scratching the underside when the bolt carrier piece 11 moves forward in the case of "continuous fire," the auto sear unit 5 comes into play in a manner known to persons skilled in the art. In the "continuous fire" position, the prestressing of the auto spring 52 causes the auto sear 51 to engage briefly with the auto sear hook 214 of the hammer 21 during the return movement of the bolt carrier 11. When the bolt carrier 11 is advanced, the hammer 21 is held until the locking process is completed and the bolt carrier 11 strikes the bottom of the auto sear 51, whereby the hammer 21 is automatically released again.

Figure 8A:
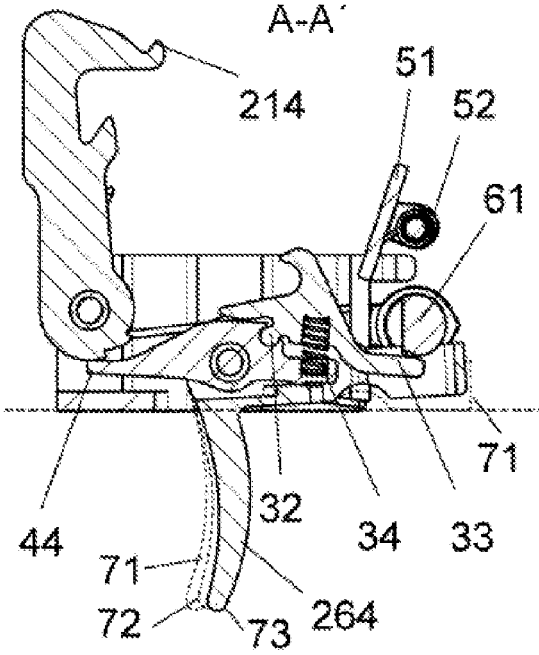
FIGS. 8A and 8B: a schematic cross-sectional view along plane A-A' of FIG. 2B for a trigger group in the fired state—hammer in strike position—with selector position "continuous fire" (8A) or "safe" (8B)
Figure 8B:
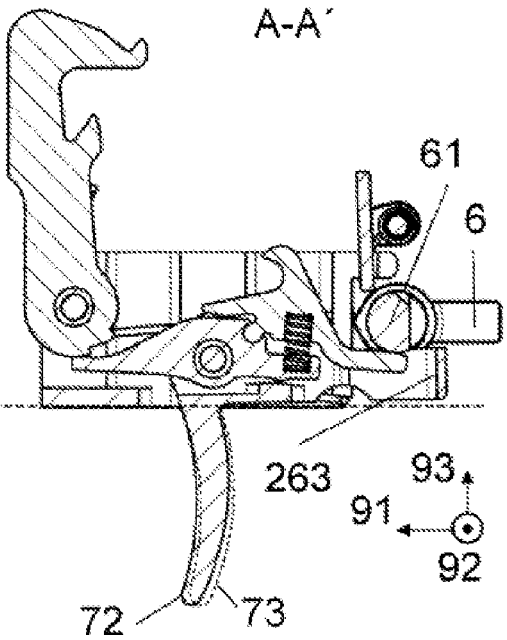

A significant advantage of the trigger unit of the present disclosure is considered to be the possibility of moving the selector 6 into the "secure" position when the hammer 21 is in the "struck" position and therefore the trigger unit 2 is not stressed. This situation is illustrated in FIG. 8. As can be seen from FIG. 8A, the hammer 21 is in the striking position, as can be the case with a fire retardant, i.e. a non-ignited cartridge. The selector 6 is shown in the "continuous firing position," whereby the situation is analogous to the "single firing position." Due to the design of the trigger unit 2 according to the present disclosure, i.e. due to the separation of the sear 4 and trigger lever 26, despite the use of a common trigger lever axis 262 or sear axis 43, the trigger rear 263 can be moved downwards into the "securing" position when the selector 6 is adjusted, as shown in FIG. 8B. In this way the sear 4 can be applied from below to the hammer 21 under prestress without obstructing the hammer 21 during a new loading process and immediately engaging again in the hammer cam 215. The auto sear unit 5 can also be brought back into the rest position unaffected by the position of the struck hammer 21 by adjusting the selector 6. This would be impossible with a one-piece trigger lever, which would engage the hammer 21 directly "forward." The situation in FIG. 8B thus shows the selector 6 in the "safe" position, whereby the trigger 264 is deflected at least until reaching the second trigger stage 72.

Another embodiment of the present disclosure concerns the formation of the sear edge 44, which has a special shape in the contact area with the hammer cam 215. An enlarged, albeit schematic, representation of the detail E from FIG. 5C shows the sear edge 44, which preferably has an inclined and/or a convex shape on the surface facing the hammer cam 215. A convex curvature of this surface makes it possible for the substantially arcuate movement of the sear 4 about the trigger axis 262, from the time the first release stage 71 is reached, to cause the reduction in the contact surface between the sear edge 44 and the trigger cam 215 to lead to a homogeneous increase in the second trigger resistance. The resulting increase in the surface pressure thus increases substantially linearly with the remaining contact surface, whereas an inhomogeneous increase in the trigger resistance would occur with a sear edge 44 with a right-angled design.

It may be advantageous in certain cases if, as shown, the sear edge 44 has a convex curvature with a radius r 441. Measured from the trigger axis 262 or sear axis 43 to the vertex of the curvature, the distance is d 442. This radius r is about the distance d, preferably smaller than the normal distance d 442 between the vertex of the convex curvature (FIG. 5*n*) and the sear axis 43. In addition, the vertex of smaller radii in the direction of rotation around the sear axis 43 can also be off-center on the sear edge 44. These correlations can be easily optimized by the person skilled in the art.

Figure 10:
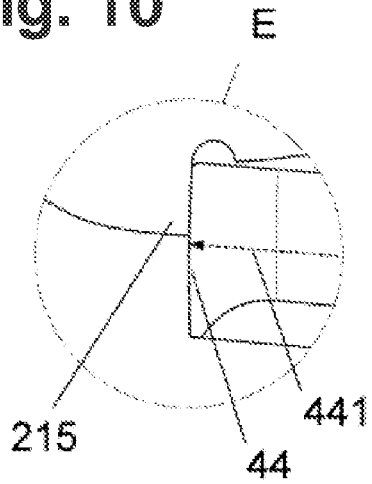
FIG. 10: the detail "E" from FIG. 5C.

Preferably, as shown in FIG. 10, the surface of the sear edge (44) is convex in regard to an axis parallel to sear axis 43. Its radius r 441, in relation to the distance d, 442, (FIG. 4A) between its apex and the trigger axis 262 or sear axis 43 (which is the same) lies in the range $0.8\ d<r<1.2\ d$, preferably $0.85\ d<r<1.1\ d$. Especially preferred are such relations with $d<r$.

The trigger unit 2 according to the present disclosure is primarily described as a drop-in trigger unit, wherein at least the hammer 21, the hammer spring 211, the disconnector 3, the disconnector spring 34, the sear 4, the sear spring 41, as well as the trigger lever 26 are arranged in a trigger unit housing 23 according to the aforementioned exemplary embodiments to form a drop-in trigger unit.

It has proved to be advantageous if the socket set screws 27, as shown for example in FIG. 2A, are provided for stressing the drop-in trigger unit. These socket set screws 27, penetrating the trigger unit housing 23 on the underside, are arranged so that they can be actuated from above, whereby the position tolerance in the lower housing 1 of a firearm can be decisively reduced.

The trigger units of the present disclosure are not restricted to the exemplary embodiment shown and described, but can be adapted and modified in various ways. This applies above all to the adaptation to other available weapons, but also to the dimension and geometry of the individual parts.

The materials that can be used are the same as in the prior art; the same applies to the manufacturing processes.

REFERENCE SIGN LIST

| | | | |
|---|---|---|---|
| 1 | Lower housing | 3 | Disconnector |
| 11 | Bolt carrier | 31 | Hook |
| 12 | Grip | 32 | Disconnector pivot |
| 13 | Magazine well | 33 | Back end |
| 14 | Magazine catch | 34 | Disconnector spring |
| 15 | Bolt catch | 35 | Disconnector axis |
| 2 | Trigger unit | 4 | Sear |
| 21 | Hammer | 41 | Sear spring |
| 211 | Hammer spring | 412 | Sear spring support |
| 212 | Hammer axis | 42 | Bearing recess |
| 213 | Hammer hook | 43 | Sear axis |
| 214 | Auto sear hook | 44 | Sear edge |
| | | 441 | r Radius |
| | | 442 | d Distance |
| 215 | Hammer cam | 45 | Sear protrusion |
| 23 | Trigger unit housing | 451 | Adjustable sear protrusion |
| 24 | Bearing sleeve | 46 | Spring recess |
| 241 | Bushing safety | 461 | Ramp |
| 25 | Inner surface | 5 | Auto sear unit |
| 26 | Trigger lever | 51 | Auto sear |
| 261 | Hammer spring support | 52 | Auto spring |
| 262 | Trigger axis | 6 | Selector |
| 263 | Trigger rear | 61 | Control shaft |
| 264 | Trigger | 71 | Rest position |
| 27 | Socket set screw | 72 | 1st trigger stage |
| | | 73 | 2nd trigger stage |

-continued

| | |
|---|---|
| 91 | Barrel direction (front) |
| 92 | Transverse direction (left) |
| 93 | Normal direction (above) |

The invention claimed is:

1. A trigger unit for a firearm, comprising:

a hammer rotatably mounted about a hammer axis and prestressable by means of a hammer spring;

a trigger lever rotatably mounted about a trigger axis, the trigger lever having a trigger and a trigger rear, where the trigger lever is formed to receive at least one disconnector; and a sear mounted rotatably about a sear axis and prestressable by means of a sear spring;

wherein the sear is arranged at least partially within the trigger lever such that the sear axis and the trigger axis coincide; and the sear has on an upper side a bearing recess for receiving a disconnector pivot formed on an underside of the disconnector, the bearing recess providing limited rotation of the disconnector about a disconnector axis, and the bearing recess at least partially enclosing the disconnector pivot in the direction of rotation about the disconnector axis.

2. The trigger unit of claim 1, wherein the trigger lever is integrally formed.

3. The trigger unit of claim 1, wherein a sear protrusion is formed on an underside of the sear.

4. The trigger unit of claim 3, wherein an adjustable adjustment device is formed on the sear for adjusting a part of the sear protrusion that projects on the underside of the sear.

5. The trigger unit of claim 4, wherein the adjustable adjustment device includes a grub screw or a prismatic adjustment member.

6. The trigger unit of claim 1, wherein an inner surface of the trigger rear facing the sear slopes backwards.

7. The trigger unit of claim 6, wherein the inner surface of the trigger rear facing the sear includes an inclined surface.

8. The trigger unit of claim 1, wherein the sear has a sear edge and a surface of the sear edge facing a hammer cam of the hammer has a convex shape.

9. The trigger unit of claim 8, wherein the convex-shaped surface of the sear edge has a radius r relative to a distance d between an apex of the convex-shaped surface and the trigger axis or sear axis in the range of $0.8\ d<r<1.2\ dl$.

10. The trigger unit of claim 8, wherein the convex-shaped surface of the sear edge has a radius r relative to a distance d between an apex of the convex-shaped surface and the trigger axis or sear axis in the range of $0.85\ d<r<1.1\ d$.

11. The trigger unit of claim 8, wherein the convex-shaped surface of the sear edge has a radius r relative to a distance d between an apex of the convex-shaped surface and the trigger axis or sear axis in the range of $0.85\ d<r<1.0\ d$.

12. The trigger unit of claim 1, wherein a sear spring support for supporting the sear spring is formed on both sides of the sear in a transverse direction.

13. The trigger unit of claim 1, wherein a hammer spring support for supporting the hammer spring is formed on both sides of the trigger lever in a transverse direction.

14. The trigger unit of claim 1, wherein an underside of the disconnector defines a recess for at least partially receiving a disconnector spring.

15. The trigger unit of claim 1, wherein the sear defines a spring recess has on a side facing the disconnector, the spring recess configured to at least partially receive the disconnector spring.

16. The trigger unit of claim 15, wherein the spring recess is at least partially open laterally in at least one transverse direction.

17. The trigger unit of claim 16, wherein the spring recess has an outwardly sloping ramp.

18. The trigger unit of claim 1, wherein at least the hammer, the hammer spring, the disconnector, a disconnector spring, the sear, the sear spring, and the trigger lever are arranged in a trigger unit housing to form a drop-in trigger unit.

19. The trigger unit of claim 18, wherein the trigger unit housing of the drop-in trigger unit is configured to be penetrated on an underside by at least one socket set screw.

* * * * *